United States Patent [19]

Bjork et al.

[11] 3,951,064

[45] Apr. 20, 1976

[54] MINE ANCHOR

[75] Inventors: Jan Bjork, Bjarred; Kjell Åke Bertil Holmgren, Trelleborg, both of Sweden

[73] Assignee: Aktiebolaget Thulinverken, Landskrona, Sweden

[22] Filed: May 7, 1974

[21] Appl. No.: 467,668

[30] Foreign Application Priority Data

May 10, 1973 Sweden ..... 7306566

[52] U.S. Cl. ..... 102/13

[51] Int. Cl.[2] ..... F42B 22/14

[58] Field of Search ..... 102/13; 9/8 R

[56] References Cited

UNITED STATES PATENTS

| | | | |
|---|---|---|---|
| 1,167,278 | 1/1916 | Elia | 102/13 |
| 1,212,048 | 1/1917 | Gierd et al. | 102/13 |
| 1,237,492 | 8/1917 | Elia | 102/13 |
| 2,971,462 | 2/1961 | Goff | 102/13 |
| 3,402,687 | 9/1968 | Tsuji | 9/8 R |

*Primary Examiner*—Charles T. Jordan

*Attorney, Agent, or Firm*—Laurence R. Brown

[57] ABSTRACT

A submarine buoyant mine is anchored at a predetermined depth under water by means of an air driven cable drive assembly which pulls in a measured length of cable to set the depth after the mine is launched and the anchor is at the bottom.

7 Claims, 8 Drawing Figures

MINE ANCHOR

Figure 1:
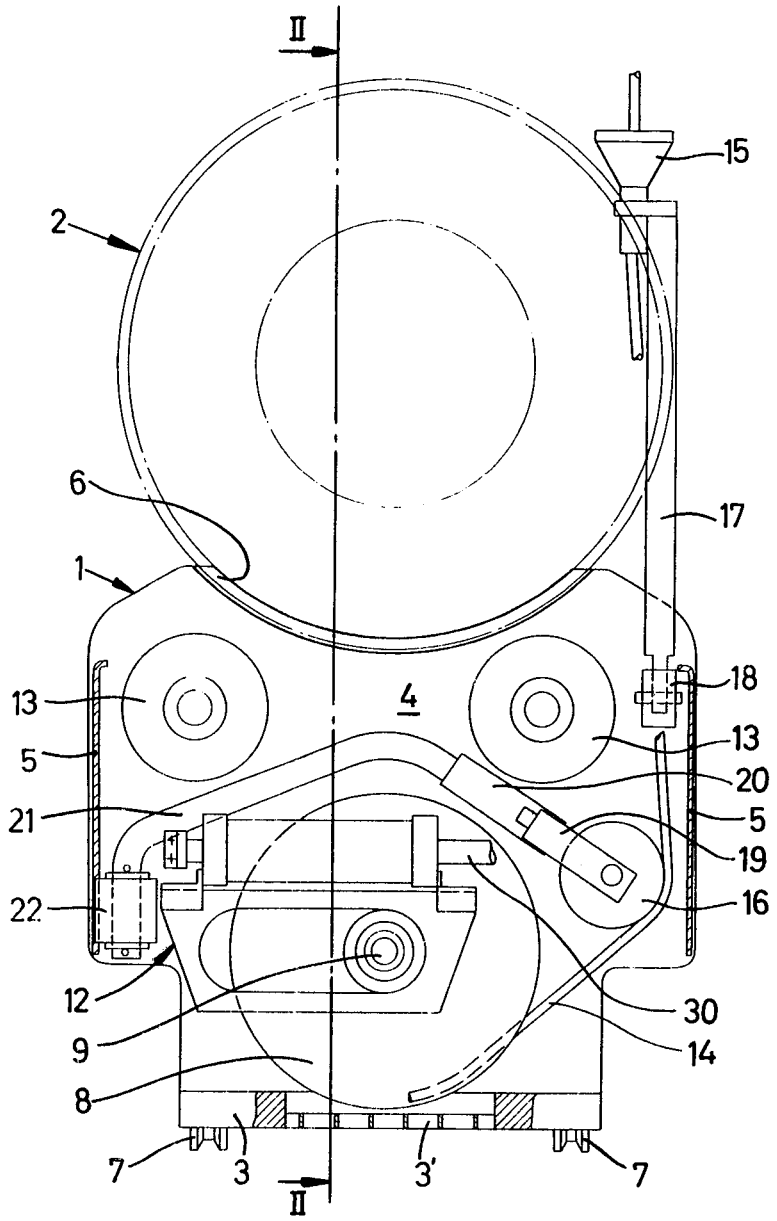

The present invention relates to a mine anchor for anchoring a submarine buoyant mine at a predetermined depth under a surface of water, which mine is connected to the anchor by a cable.

There are three earlier mine anchor types with different modes of operation for the mine anchors and their mines at the launching and anchoring at the predetermined depth.

At the first type the mine anchor is provided with a plummet, whose plummet line has a length corresponding to the desired mine depth. The mine anchor will after launching sink preceded by the plummet, whereas the mine will stay at the surface of water. When the plummet has reached the bottom a suitable mechanism will lock the cable to the mine anchor, so that further pulling out of cable will be prevented and the mine will follow the mine anchor down until the latter has reached the bottom and the mine is anchored at the predetermined depth.

At the second type the mine is provided with a float, whose float line has a length corresponding to the desired mine depth. The mine anchor with its mine will after launching sink until the float line is stretched due to the fact that the mine has reached the desired depth. The mine anchor will then be freed from the mine and will sink to the bottom under pulling out of cable from the anchor. When the anchor has reached the bottom the cable will be locked thereto and the float will be water-filled so as to disappear from the surface of water.

The common disadvantages with these two types are that the plummet line and the float line respectively can cause trouble and that the different mechanisms for releasing and locking the different parts involved are complex and liable to go wrong. A further disadvantage with the former type is that after the plummet has reached the bottom and the cable has been locked to the mine anchor, streams in the water can move the mine anchor to a place with another bottom depth, so that the final mine depth will differ more or less from the desired.

At the third type the mine anchor is provided with a hydrostat, which can be defined as a manometer and can detect the water depth by the water pressure. The mine will after launching follow the mine anchor to the bottom where the hydrostat will feel the water pressure, whereafter the mine anchor will release the mine and let out a length of cable corresponding to the difference betweeen the bottom depth and the pre-set mine depth.

The main disadvantage with this type is that it is difficult to obtain the desired accuracy with a hydrostat, especially if the bottom depth is more than 100 m. The accuracy is also affected by the salinity of the water.

The object of the invention is thus to accomplish a mine anchor without the disadvantages mentioned above. The mine anchor shall work without any plummet or float and the mine shall be anchored with great accuracy at the predetermined depth. The mine anchor shall further work properly at greater bottom depths than 100 m.

These and other objects are attained in that the mine anchor according to the invention is characterised by a cable pulling means with a source of energy as well as by control means for initiating the cable pulling at a situation after the mine-launching with the mine at the surface of the water and the anchor on the bottom and for breaking off the same after the pulling in of a length of cable corresponding to the predetermined depth.

It is important to note that many constructive solutions are possible for the cable pulling means and the source of energy as well as the control means. It is for example possible to use an electric accumulator as the source of energy and an electric motor as the cable pulling means and also to use electric control means.

Among other things due to the operating in water it is preferred that the cable pulling means is a pneumatic driving assembly connected to a cable drum and that the source of energy is at least one compressed-air tank.

In a preferred embodiment this driving assembly comprises a double-acting pneumatic cylinder-piston unit and a transmission device for transferring the reciprocating working movement from the said unit to a rotational movement of the cable drum in the cable winding direction.

This transmission device can be composed of a drive disc attached to the shaft of the cable drum, further of spur gear wheels rotatably arranged on the said shaft one on each side of the drive disc and resiliently held against the latter by springs, the co-operating surfaces of the drive disc and the gear wheels being provided with detents for transferring rotational movement to the drive disc only in one direction, and finally of a carriage mounted on the movable cylinder of the cylinder-piston unit and provided with two racks each in engagement with one of the gear wheels on opposite sides of these.

As already said the cable pulling shall not start until the situation with the mine anchor on the bottom and the mine at the surface of water has been reached. The mine anchor shall thus be free to sink and to let out cable during this sinking. It is preferred to control this sinking in order to keep the cable stretched. The cable drum of the mine anchor shall thus be free to rotate in the unwinding direction for the cable during the sinking, but this rotation must be controlled.

This is obtained in that the carriage is provided with disengagement shoulders for moving apart the two gear wheels against the action of the springs and with braking means for cooperation with the drive disc.

It would be possible to break off the cable pulling by cutting off the supply of compressed air to the pneumatic cylinder of the driving assembly, when the desired depth had been reached. In the preferred embodiment, however, the control means for breaking off the cable pulling consist of a measuring and clamping device holding the cable after the pulling in of the predetermined length of cable and comprising a rotatable cable wheel, over which the cable is arranged to run causing the wheel to rotate, a measuring spindle arranged to move axially into the tubular shaft of the cable wheel only at the pulling in of the cable, and a clamp coacting with the spindle and arranged to clamp the cable against the cable wheel after releasing from the spindle depending on the said movement. This solution is entirely mechanical and gives a better accuracy than a pneumatic one and is more reliable.

During the sinking of the mine anchor, when the cable is driving the cable wheel in the opposite direction, the measuring spindle shall not be actuated, and therefore there is a one-way coupling arrangement between the cable wheel shaft and the measuring spindle.

It is normal to have a power-driven cable guide at a cable drum to ensure a proper winding of the cable onto the drum. A cable guide of this kind is complex and expensive. In the preferred embodiment the cable guide has the form of on one hand a hawse arranged on the mine anchor frame, on the other hand the cable wheel rotatably supported by a fork, which is rockably mounted in relation to a cable wheel arm pivotally journalled in the mine anchor frame for movement in a plane substantially parallel with the cable drum shaft. No external power is thus required, since the entering cable is properly guided onto its place by the preceding turn of winding.

It is to be noted that many modifications are possible within the scope of the appended claims.

Figure 2:
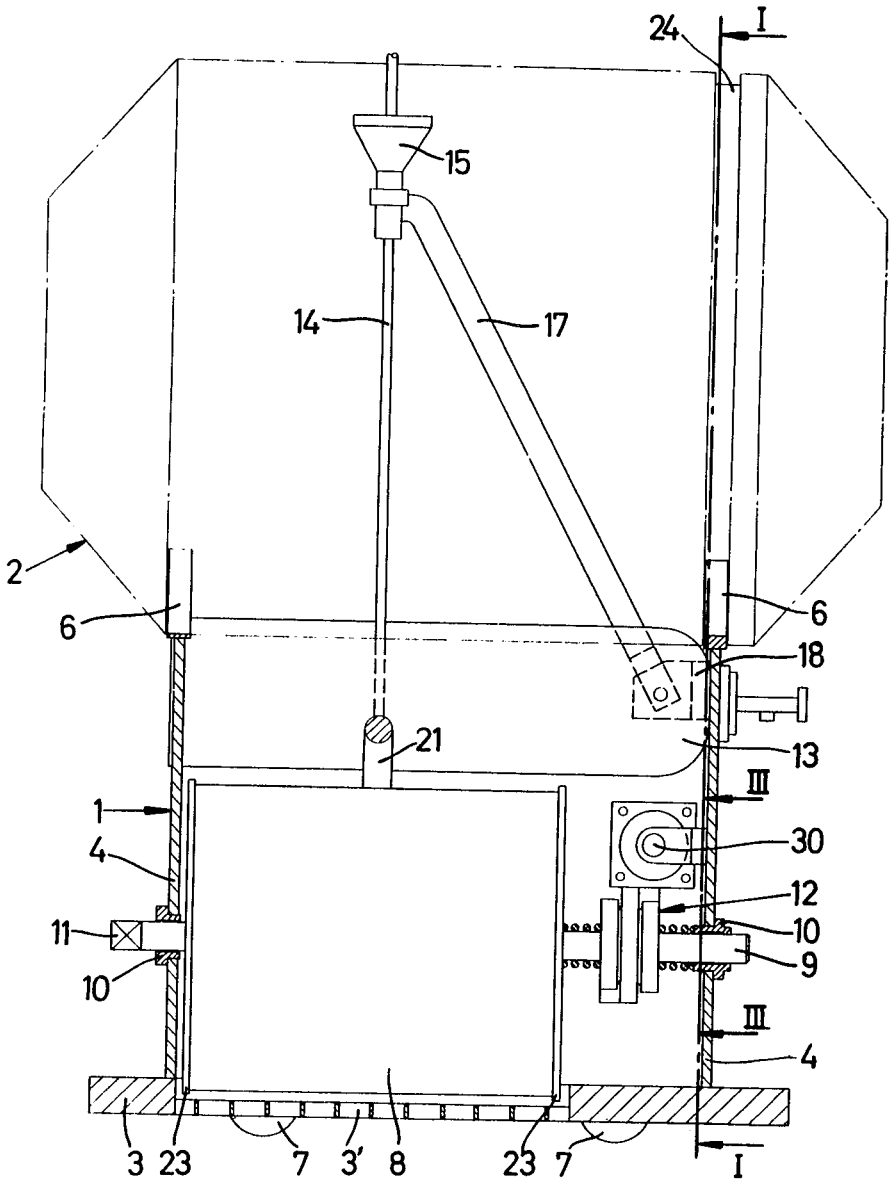
Figure 3:
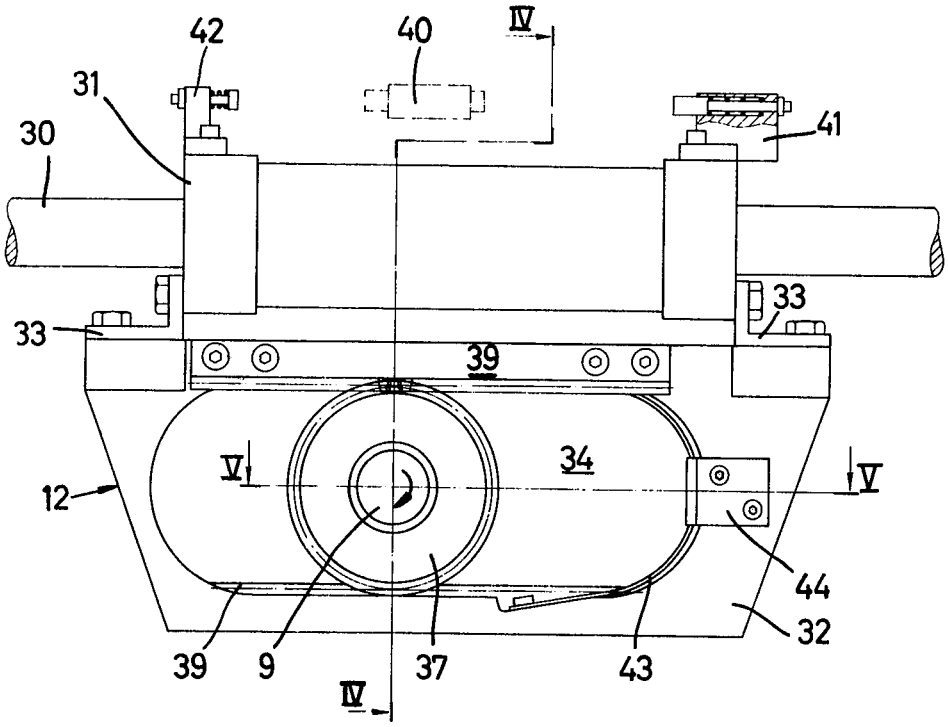
Figure 4:
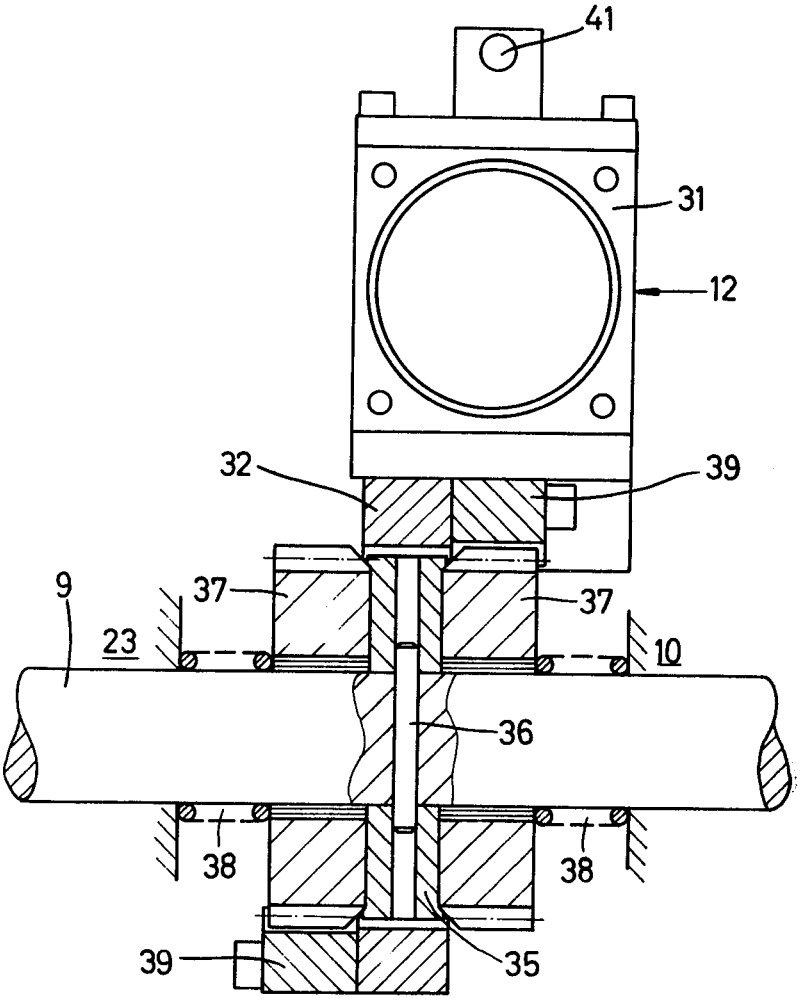
Figure 5:
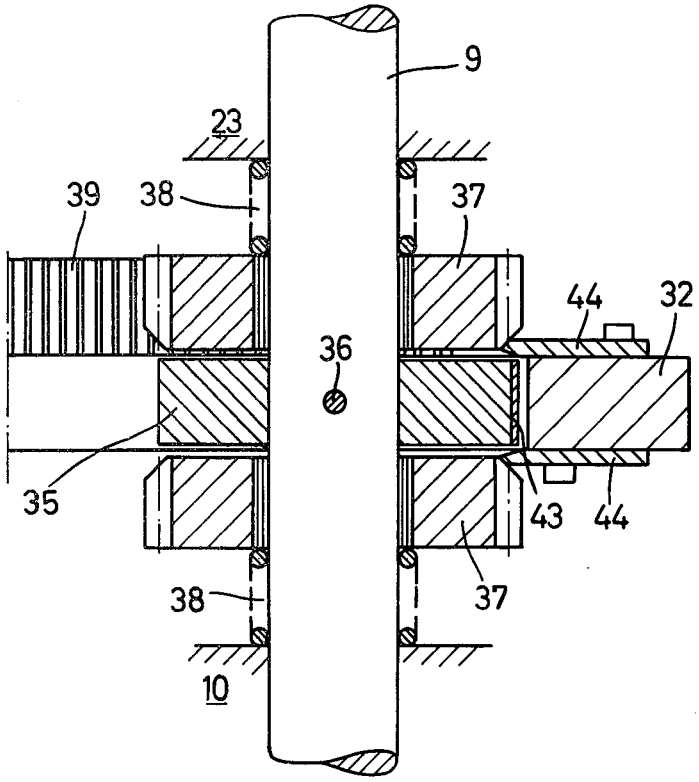
Figure 6:
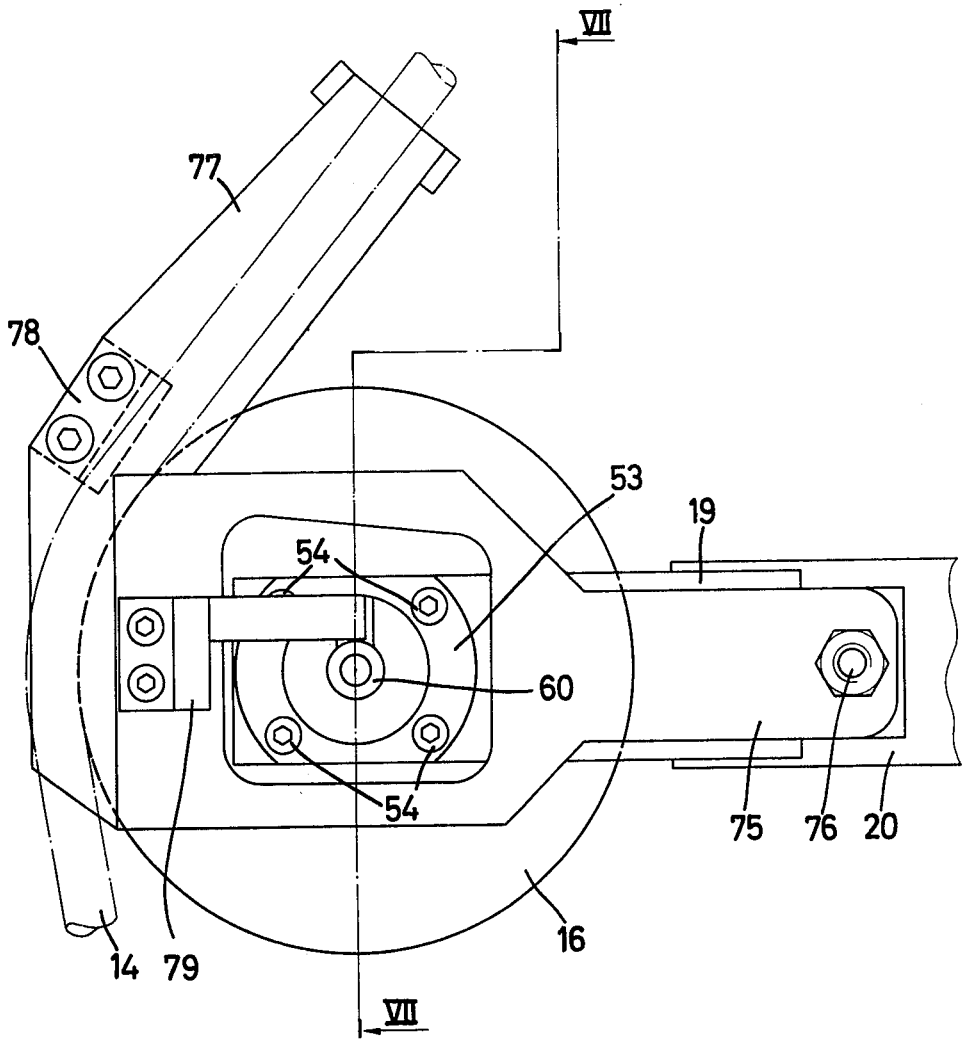
Figure 7:
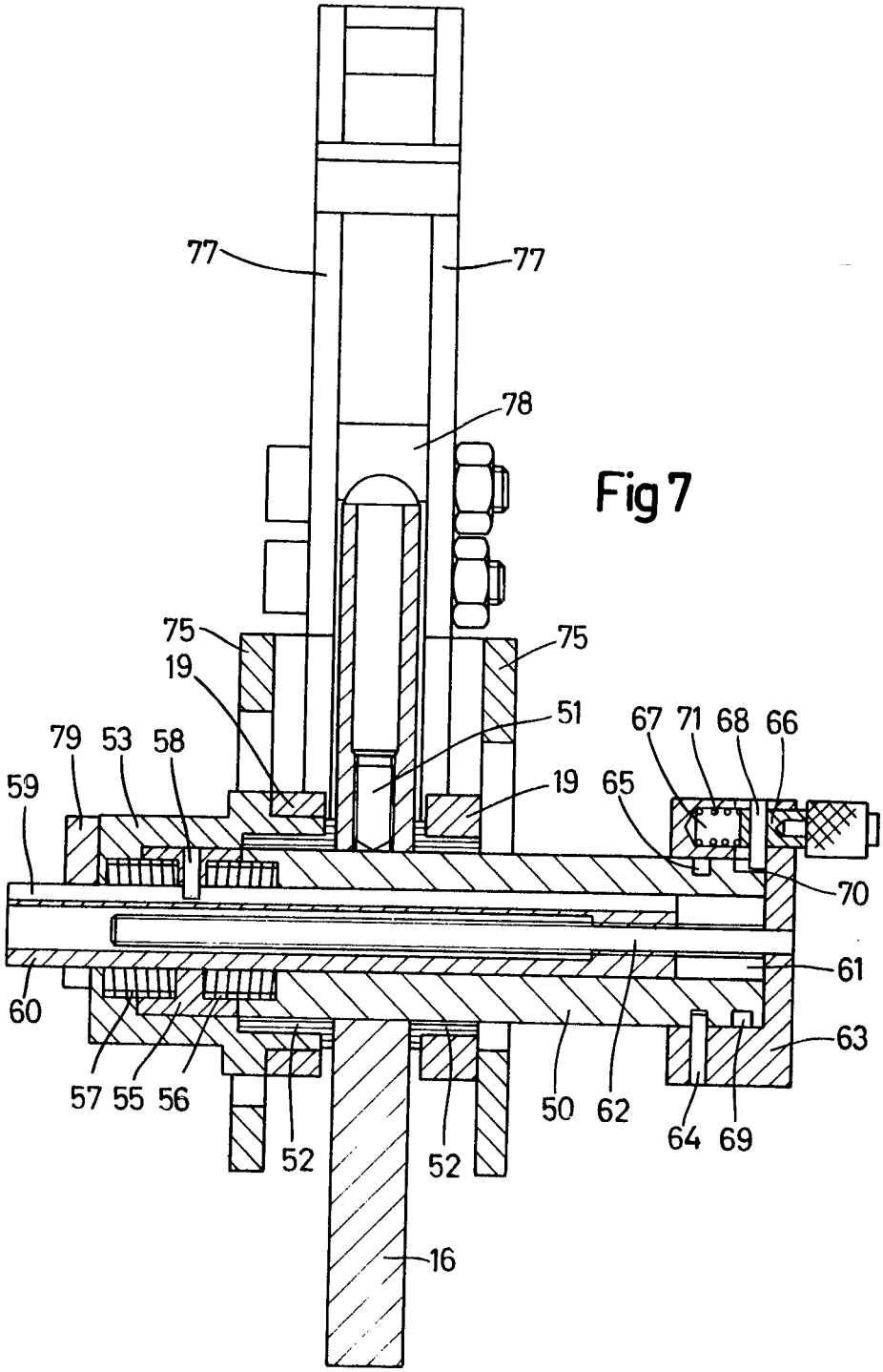
Figure 8:
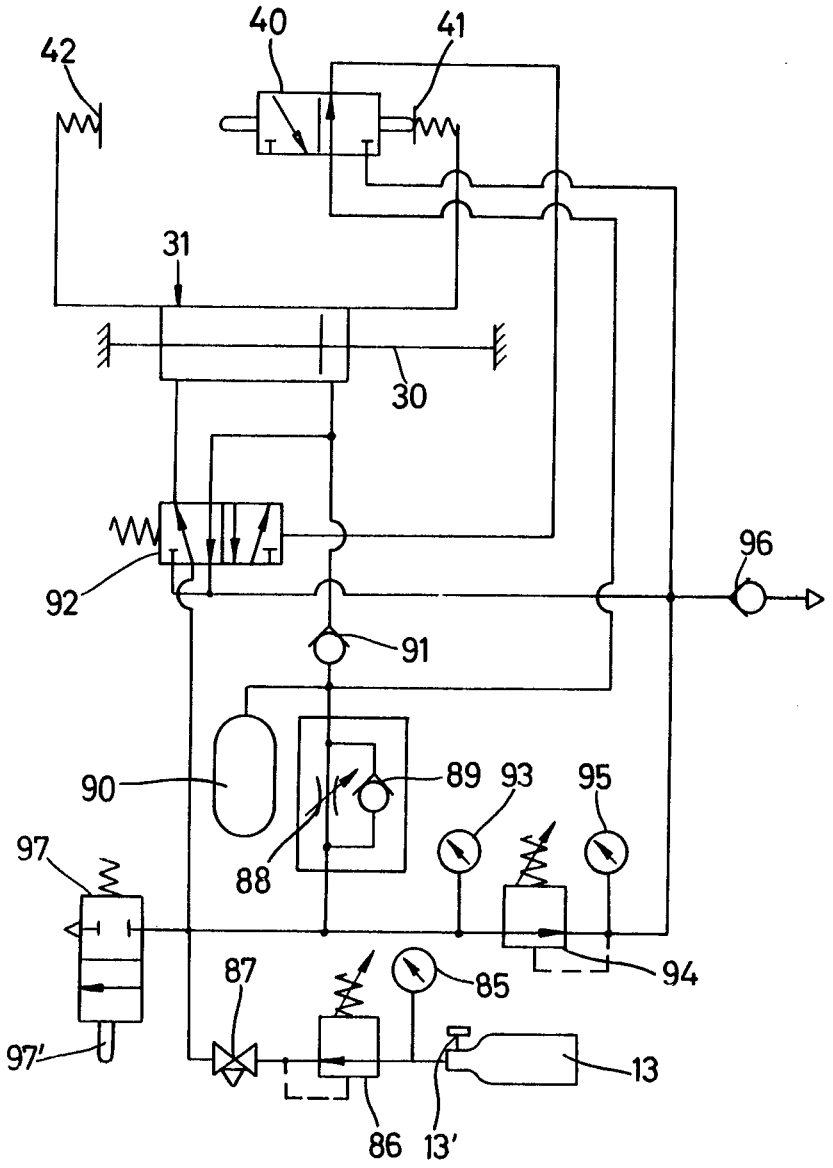

The invention shall be described in further detail below, references being made to the accompanying drawings, in which FIG. 1 is a section substantially along the line I—I in FIG. 2 of a mine anchor according to the invention with a mine indicated in dash-dotted lines, FIG. 2 is a section substantially along the line II—II in FIG. 1, FIG. 3 is a view of the driving assembly substantially along the line III—III in FIG. 2 on a larger scale, FIG. 4 is a section of the driving assembly substantially along the line IV—IV in FIG. 3 on a still larger scale, FIG. 5 is a further section of a part of the driving assembly substantially along the line V—V in FIG. 3 but with the elements in the position they have during the sinking of the mine anchor, FIG. 6 is a side view of the cable measuring and clamping device of the mine anchor but shown from the other side as compared to FIG. 1 and to a larger scale, FIG. 7 is a section substantially along the line VII—VII in FIG. 6 on a still larger scale, and FIG. 8 is a diagram showing the pneumatic system of the mine anchor according to the invention.

FIGS. 1 AND 2

In FIGS. 1 and 2 are shown a mine anchor 1 according to the invention and a submarine buoyant mine 2 which can be of a conventional design. The mine 2 is shown in dash-dotted lines to indicate that it does not form any part of the invention and that the shown relationship between some of the parts of the mine anchor 1 and the mine 2 will never occur, as will be clear from the description below.

A frame for the mine anchor consists of a base plate 3, two end plates 4 and two side plates 5, all welded together to form a casing for all the different parts to be described below and a support for the mine before launching. Each end plate 4 is provided with a welded strip iron 6 to ensure a proper support for the mine. Four wheels 7 for moving the mine anchor with its mine on board a ship are rotatably attached to the base plate 3, which is also provided with a latticed part 3′ for allowing water to pass freely.

In order to give an idea about the actual size of the mine anchor it can be mentioned that the size of the base plate 3 is 600 × 1000 mm.

A cable drum 8 is attached to a cable drum shaft 9 which is rotatably journalled in the end plates 4 by bearings 10. The end part of the shaft 9 extending out from the left end plate 4 (as viewed in FIG. 2) is provided with a grip 11 for any manual turning of the cable drum 8.

A pneumatic driving assembly, which has the general numeral 12 and is to be described in further detail under reference to FIGS. 3–5, is attached to the right end plate 4 (as viewed in FIG. 2) and is drivingly connected to the cable drum shaft 9.

Two compressed-air tanks 13 are mounted between the two end plates 4 and supply compressed air to the pneumatic driving assembly 12 as will be further described under reference to FIG. 8.

A cable 14 connects the mine 2 to the mine anchor 1 and is guided on one hand by a hawse 15 and on the other hand by a cable wheel 16.

The hawse 15 is arranged on a hawse arm 17 which is pivotally connected to a hawse arm attachment 18 on the right end plate 4 (as viewed in FIG. 2). In storage position, when the mine 2 is supported on the mine anchor 1, the hawse arm 17 is lowered to a horizontal position, but when the buoyant mine has left the mine anchor after the launching there will be a pulling force in the cable 14 causing the hawse arm 17 to be raised to its shown position; the hawse arm will be held in this position by a spring-biased latch mechanism (not shown).

The cable wheel 16 is rotatably journalled in a cable wheel fork 19, which is rigidly secured to a sleeve 20. This sleeve 20 is rockably or circumferencially movably mounted on a cable wheel arm 21, which is pivotally journalled in a cable wheel arm attachment 22 secured to the left side plate 5 (as viewed in FIG. 1) in front of the cable drum 8. The arrangement with the cable wheel 16 and its fork 19 is shown in further detail in FIGS. 6 and 7; it is to be noted that a cable clamping mechanism shown in these figures is not shown in FIG. 1 for the sake of simplicity.

The described cable guiding means in the form of the stationary hawse 15 and the cable wheel 16 movable in different planes by being movably attached to the movable cable wheel arm 21 are so geometrically arranged in relation to each other and to the cable drum 8 that the entering cable is always slightly pressed against the preceding turn which means that the consecutive cable turns on the cable drum will come in order close together without any other force than the pull in the cable and the constraining force from the cable drum end discs 23. This is very important since otherwise the design would have been much more complicated. In the practical embodiment the cable will be wound in five layers on the cable drum 8.

MODE OF OPERATION

For the proper understanding of the following description of the pneumatic driving assembly (FIGS. 3–5), the cable measuring and clamping mechanism (FIGS. 6 and 7), and the pneumatic system (FIG. 8) of the mine anchor it is suitable to give a brief description of the functioning of the mine anchor together with the mine at the mine laying or launching.

After the launching the mine and the mine anchor will start to sink as a unit, as they are coupled together by a strap. After a short while, when this unit has sunk about 5 m, this strap, which is placed in a a notch 24 in the mine, will be released by means of a releasing mechanism (not shown) acted on by the increasing water pressure. The buoyant mine will then rise to the sea level, whereas the mine anchor will sink to the bottom. In order to control this sinking and to keep the cable between the mine and the mine anchor stretched there is a braking arrangement (to be described under reference to FIGS. 3–5) in the pneumatic driving assembly. If the buoyant force is say 2000 N the braking force can be in the order of 1300 N. When the mine anchor has reached the bottom the braking arrangement will hold the cable stretched in spite of forces acting on the mine and the cable, for example from streams in the water.

When a certain time has lapsed the pneumatic driving assembly will begin to pull in the cable and thus the mine, until a predetermined length has been pulled in corresponding to the desired depth for the mine, whereupon a clamping mechanism will be activated and will hold the cable against any further movement.

FIGS. 3–5

The pneumatic driving assembly 12 will now be described under reference to FIGS. 3–5.

As can be seen in FIGS. 1 and 2 a piston rod 30 is attached at both its ends to the right end plate 4 (as viewed in FIG. 2). A double-acting pneumatic cylinder 31 is reciprocably movable along this fixed piston rod 30 and is attached to a carriage 32 by means of cylinder attachments 33. This carriage 32 has an oblong aperture 34 for other parts of the assembly connecting the carriage to the cable drum shaft 9, which can also be called a drive shaft.

This shaft 9 is provided with a drive disc 35 attached thereto by a pin 36. On each side of this drive disc 35 there is rotatably journalled on the shaft 9 a spur gear wheel 37. Each gear wheel 37 is resiliently held against the drive disc 35 by a helical compression spring 38 acting between on one hand the gear wheel and the shaft bearing 10 and on the other hand the gear wheel and the cable drum end disc 23. The co-operating surface of the drive disc 35 and the gear wheels 37 are provided with detents with such locking direction that driving force can only be tranferred to the drive disc 35 and thus to the cable drum shaft 9 in one rotational direction in spite of the fact that an oscillating movement will be imparted to the gear wheels by the cylinder 31 and the carriage 32 as will be apparent below.

The carriage 32 is thus at the aperture 34 provided with two racks 39 each in engagement with one of the gear wheels 37 on opposite sides of those as shown in FIG. 4.

As the cable drum shaft 9 shall be driven in the rotational direction shown with an arrow in FIG. 3 the detents on the co-operating surfaces of the gear wheels and the drive disc are such that the following will occur at the reciprocating of the cylinder and the carriage: When the carriage 32 is moving to the right in FIG. 3 the right gear wheel in FIG. 4 will transfer its rotational movement to the drive disc 35 via the detents, whereas the left gear wheel will only slip on the detents. On the other hand, when the carriage 32 is moving to the left in FIG. 3 the left gear wheel in FIG. 4 will drive disc 35, whereas the right gear wheel will not transfer any movement to the drive disc.

During the pulling in of the cable 14 the cylinder 31 is moving to and fro on the piston rod 30 under the influence of compressed air from the compressed-air tanks 13. To control the letting in of air to the cylinder there is an impulse valve 40 (FIG. 3) attached to the right end plate 4 (as viewed in FIG. 2) whereas there are two spring-dampened cams 41 and 42 co-operating with the impulse valve and mounted on the cylinder 31: a primary one 41 mounted at the right hand end (FIG. 3) of the cylinder and a secondary one 42 at the other end. The impulse valve 40 will be described below with reference to FIG. 8.

At the right hand side of the carriage aperture 34 (as viewed in FIG. 3) there is a braking arrangement mentioned above in connection with the functioning of the mine anchor and especially its sinking. This braking arrangement consists primarily of a brake strap 43 mounted at the right hand end of the carriage aperture 34 (as viewed in FIG. 3) but also two disengagement shoulders 44 mounted one on each side of the carriage 32 at the brake strap 43 as shown in FIGS. 3 and 5. Before the pneumatic system (to be described later under reference to FIG. 8) has started the working cycle of the pneumatic drive assembly 12 and thus during the sinking of the mine anchor the carriage 32 will be held in one of its extreme positions so that the position according to FIG. 5 will prevail. The disengagement shoulders 44 will engage bevelled edges on the gear 37 as shown, so that the detents on these gear wheels and the drive disc 35 will be kept out of engagement with each other, at the same time as the brake strap 43 will exert a braking force on the else free drive disc 35. The result will of course be a controlled pulling out of the cable 14 from the mine anchor during the sinking thereof.

After the pneumatic system has started the working cycle the now described position will never occur again as the cylinder 31 and the carriage 32 will change its direction of motion under the influence of the impulse valve 40 controlled by the primary cam 41 before the said position is reached.

FIGS. 6 AND 7

In FIGS. 6 and 7 there is shown the cable measuring and clamping mechanism of the mine anchor, and it is to be noted that FIG. 6 is a view from the other side of this mechanism as compared with FIG. 1 in order to more clearly show some details in the design.

As already mentioned in connection with FIG. 1 a cable wheel 16 is journalled in a cable wheel fork 19 rigidly secured to a sleeve 20. The cable wheel 16 is thus secured to a cable wheel shaft 50 by a locking screw 51, and this shaft 50 is journalled in the fork 19 by means of bearings 52. It is to be noted that between the left bearing (as viewed in FIG. 7) and the corresponding part of the fork 19 there is a bearing housing 53 secured to the fork by screws 54 (FIG. 6). A cylindrical driver 55 is arranged between the cable wheel shaft 50 and the bearing housing 53. A one-way clutch in the form of a locking spring 56 is connecting the shaft 50 with the driver 55; this locking spring can be called the shaft side locking spring. Another locking spring 57 is connecting the bearing housing 53 with the driver 55; this locking spring can logically be called the housing side locking spring.

The driver 55 is provided with a driver pin 58, which extends into a longitudinal groove 59 in a measuring spindle 60. This spindle is movably arranged in a longitudinal bore 61 in the cable wheel shaft 50 and is threadingly engaging a screw 62 secured to a depth setting knob 63, which is rotationally movable but axially immovable in relation to the cable wheel shaft end by means of at least one pin 64 extending into a first circumferential groove 65 in the cable wheel shaft 50. The depth setting knob 63 may be turned relative to the shaft 50 by a crank 66 arranged in a blind hole 67 in the knob and provided with a crank pin 68, which extends into a second circumferential groove 69. This groove is provided with at least one axial notch 70, and the crank pin 68 is biassed into this notch by a helical compression spring 71 arranged in the blind hole 67; this position is shown in FIG. 7.

It is evident that by turning the depth setting knob 63 by means of the crank 66 after pressing in the same it is possible to turn the screw 62 and to move the measuring spindle 60 relative to the cable wheel shaft bore 61 provided that the driver pin 58 will prevent the spindle 60 from rotating during this movement by its engagement with the longitudinal groove 59 in the spindle 60. This is the case owing to the locking directions of the locking springs 56 and 57 holding the driver in relation to the cable wheel shaft 50 during this movement.

When the cable 14 is pulled out during the sinking of the mine anchor causing the cable wheel 16 and thus the cable wheel shaft 50 to rotate in the counter-clockwise direction in FIG. 1 this rotational movement will be transmitted to the driver 55 and thus the spindle 60 owing to the locking direction of the locking springs 56 and 57, so that the spindle will maintain its position relative to the shaft 50. On the other hand, when the cable 14 is pulled in during the pulling down of the mine to the desired depth the cable wheel and its shaft 50 will rotate in the opposite direction. This rotational movement will not be transmitted to the measuring spindle 60 due to the fact that the driver 55 will be held stationary relative to the bearing housing 53 by the housing side locking spring 57. This means that the spindle 60 by its engagement with the rotating screw 62 will be moved into the shaft bore 61 or to the right in FIG. 7. The result of this spindle movement will be clear from the following description of the cable clamping mechanism associated with the cable measuring device described above.

On the sleeve 20 associated with the cable wheel fork 19 there is pivotally attached a holder 75 by means of a screw 76. The holder 75 is placed astraddle of the cable wheel 16 and its fork 19 as shown in FIG. 7. The holder 75 is provided with a cable guide 77 and also a clamping jaw 78 in such a position relative to the cable wheel 16 that the cable 14 can pass between the jaw and the wheel in the situation shown in the drawings. On the front holder part as viewed in FIG. 6 or the left holder part as viewed in FIG. 7 there is secured a stop lug 79 for co-operation with the measuring spindle 60.

When this measuring spindle 60 is extending out of the cable wheel shaft 50 as shown in the drawings the stop lug 79 will rest on the spindle. When, however, the measuring spindle 60 has been completely drawn into the cable wheel shaft 50 at the pulling in of the cable 14 the stop lug 79 and thus the holder 75 will not have anything to rest on and will pivot down due to the gravity. This will mean that the clamping jaw 78 will clamp the cable 14 against the cable wheel 16 and prevent any further pulling in of the cable. The clamping force obtained will namely be so big that the force from the pneumatic cylinder 31 will be unable to overcome it.

As the cable wheel circumference in the practical embodiment is 0.5 m and the thread pitch of the screw 62 is 0.5 mm, each full turn of the depth setting knob 63 will mean a mine depth change of 0.5 m and a movement of 0.5 mm for the spindle 60 from the bearing housing 53. If for example a mine depth 20 m is desired the depth setting knob 63 will have to be turned until the measuring spindle 60 projects 20 mm from the bearing housing 53.

FIG. 8

In FIG. 8 which shows the pneumatic system of the mine anchor, the following parts can be recognized from the other drawings and the description above: the compressed-air tank 13 with its usual tank shut-off valve 13' (two tanks in the practical embodiment), the fixed piston rod 30, the cylinder 31, the impulse valve 40 and the two cams 41 and 42 attached to the cylinder 31 and coacting with the impulse valve 40 (which is attached to the right end plate 4 as viewed in FIG. 2).

Besides these already mentioned elements there are the following parts in the system together with appropriate piping as shown in FIG. 8: a tank pressure manometer 85, a primary pressure regulator 86, a main shut-off valve 87, a thorttle valve 88, a first nonreturn valve 89 parallel with the throttle valve 88, a pressure tank 90, a second nonreturn valve 91, a directional valve 92, a working pressure manometer 93, a secondary pressure regulator 94, a venting pressure manometer 95, a nonreturn venting valve 96, and an exhaust valve 97. These parts except the exhaust valve 97 are mounted together at the right end plate 4 as viewed in FIG. 2.

Any time before the launching of the mine anchor and the mine the tank shut-off valve 13' is opened, whereas the main shut-off valve 87 is opened immediately before the launching. The tank pressure, which is the order of 200 bar and is indicated by the tank pressure manometer 85, is reduced by the working pressure regulator 86 to a working pressure of 30 bar indicated by the working pressure manometer 93. This working pressure is further reduced by the secondary pressure regulator 94 to a secondary pressure of 0.5 bar which is not enough to open the nonreturn venting valve 96 which is set to open at a pressure of 1 bar and will prevent water from entering the system under all circumstances.

Air under working pressure is also passing to the left side of the piston in the cylinder 31 as viewed in FIG. 8 via the directional valve 92, which is a four-way valve, air-governed with spring-return and thus held in the shown rest position by a spring. The working pressure in the cylinder 31 will hold the brake strap 43 (FIG. 5) against the drive disc 35 during the sinking of the mine anchor, so that, as mentioned, a braking force of say 1300 N will be obtained.

Air is further passing the throttle valve 88 to the pressure tank 90 as well as past the impulse valve 40 to the directional valve 92 for governing this. The impulse valve 40 is a three-way valve mechanically governed by the cams 41 and 42. The throttling of the throttle valve 88 and the volume of the pressure tank 90 (being say 2.5 l) are such that enough pressure — 3 a 5 bar — for switching over the direction valve 92 will be attained after 2–4 min from the opening of the main shut-off valve 87. This time-delay means that the mine with its mine-anchor can be launched and the mine anchor after sinking can come to a rest on the bottom before the pulling-in of the cable 14 is initiated by the first switch-over of the directional valve 92. After a working stroke of the cylinder 31 to the right in FIG. 8 the secondary cam 42 will switch over the impulse valve 40, so that the governing air at the directional valve 92 will be vented through the impulse valve and the nonreturn venting valve 96 and thus so that the directional valve spring will move this valve back to its shown position.

This working cycle causing the cable to be pulled onto the cable drum 8 will continue until the measuring and clamping device according to FIGS. 6 and 7 will clamp the cable 14 and prevent any further pulling in of the same.

At the same time an acutating pin 97' of the normally closed and mechanically actuated exhaust valve 97 (not shown in FIGS. 6 and 7) will be pushed in owing to the relative movement between the sleeve 20 and the holder 75, so that the air under pressure in the system will be rapidly exhausted. Thereafter the detents on the co-operating surfaces of the drive disc 35 and the gear wheels 37 (FIG. 4) will prevent the buoyant mine from pulling out the cable 14 and rising to the sea level.

As already mentioned the secondary pressure regulator 94 will keep a pressure of 0.5 bar above the water pressure in the venting part of the compressed-air system. The reason for this is that the absolute working pressure in the system will increase in the water due to the increasing water pressure. At a mine anchor depth of for example 150 m (which is easily attainable as the length of the cable 14 in the practical embodiment is 170–200 m) the absolute working pressure will have been increased from 30 bar to 45 bar.

The function of the two nonreturn valves 89 and 91 is to allow a fast venting of the system through the main shut-off valve 87 (which in fact is a three-way valve with venting from the system to the atmosphere in one position) if it should be desired to break off the operation of the system after a while, for example during testing.

It is to be noted that the invention is not limited to the embodiment shown and described and that many modifications are possible within the scope of the appended claims.

We claim:

1. A mine anchor assembly for anchoring a submarine buoyant mine at a predetermined depth under the water surface, comprising in combination, means for connecting a mine to an anchor by a cable, means for letting the anchor carry the cable to the bottom with the mine being afloat near the surface, cable pulling means, an energy source for driving said pulling means, start control means for initiating the cable pulling means after launching the mine at the surface of the water when the anchor is on the bottom thereby to pull the mine toward the anchor by said cable, and stop control means for breaking off the cable pulling after pulling in a measured length of cable identifying a predetermined depth of the mine wherein the cable is wound on a drum and the cable pulling means is a pneumatic driving assembly for said drum, and the source of energy is a compressed air tank.

2. A mine anchor as defined in claim 1, wherein the driving assembly comprises a double-acting pneumatic cylinder-piston unit and a transmission device for transferring the reciprocating working movement from the piston unit to a rotational movement of said cable drum in a cable winding direction.

3. A mine anchor as defined in claim 2, wherein said drum is mounted for rotation with an axial shaft extending therefrom characterized by a drive disc attached to the shaft of the cable drum, further by spur gear wheels rotatably arranged on the said shaft one on each side of the drive disc and resiliently held against the latter by springs, the co-operating surfaces of the drive disc and the gear wheels being provided with detents for transferring rotational movement to the drive disc only in one direction, and finally by a carriage mounted on the movable cylinder of the cylinder-piston unit and provided with two racks each in engagement with one of the gear wheels on opposite sides of these.

4. A mine anchor as defined in claim 3, characterized in that the carriage is provided with disengagement shoulders for moving apart the two gear wheels against the action of the springs and with braking means for co-operation with the drive disc.

5. A mine anchor according to claim 1, characterized in that the control means for breaking off the cable pulling consist of a measuring and clamping device holding the cable after the pulling in of the predetermined length of cable and comprising a rotatable cable wheel, over which the cable is arranged to run causing the wheel to rotate, a tubular shaft for said wheel, a measuring spindle arranged to move axially into the tubular shaft of the cable wheel only at the pulling in of the cable, and a clamp coacting with the spindle and arranged to clamp the cable against the cable wheel after releasing from the spindle depending on the said movement.

6. A mine anchor according to claim 5, characterized by a one-way coupling arrangement between the cable wheel shaft and the measuring spindle.

7. A mine anchor according to claim 1, having a mine anchor frame wherein the drum has a shaft and characterized by cable guide means comprising a hawse arranged on said mine anchor frame and a cable wheel rotatably supported by a fork disposed on an arm pivotally journalled in the mine anchor frame for movement of said wheel in a plane substantially parallel with said drum shaft.

* * * * *